US006799524B2

(12) United States Patent
Marks

(10) Patent No.: US 6,799,524 B2
(45) Date of Patent: Oct. 5, 2004

(54) MODULAR SECURITY VAULT PANELS

(75) Inventor: Anthony P. Marks, Cape Coral, FL (US)

(73) Assignee: Vault Structures, Inc., Ft. Myers, FL (US)

( * ) Notice: Subject to any disclaimer, the term of this patent is extended or adjusted under 35 U.S.C. 154(b) by 0 days.

(21) Appl. No.: 10/190,924

(22) Filed: Jul. 8, 2002

(65) Prior Publication Data

US 2003/0029363 A1 Feb. 13, 2003

Related U.S. Application Data

(63) Continuation of application No. 09/375,035, filed on Aug. 16, 1999, now Pat. No. 6,418,863.

(51) Int. Cl.[7] ..... E04B 2/02

(52) U.S. Cl. ..... 109/84; 52/270; 52/284; 264/35

(58) Field of Search ..... 109/78–84; 264/35; 52/79.14, 250, 270, 284, 745.01, 800.1

(56) References Cited

U.S. PATENT DOCUMENTS

| | | | | |
|---|---|---|---|---|
| 3,394,523 A | 7/1968 | Sackett, Sr. | 52/584 |
| 3,566,572 A | 3/1971 | Wilkinson | 52/745 |
| 3,578,732 A | 5/1971 | Lount et al. | 264/34 |
| 3,885,008 A | 5/1975 | Martin | 264/45.3 |
| 4,048,270 A | 9/1977 | Stegmeier | 264/35 X |
| 4,055,927 A | 11/1977 | Tamaro | 52/577 |
| 4,059,939 A | 11/1977 | Elliott | 52/745 |
| 4,388,874 A | 6/1983 | Stone | 109/79 |
| 4,389,948 A | 6/1983 | Sands et al. | 109/82 |
| 4,559,881 A | 12/1985 | Lankard et al. | 109/83 |
| 5,033,248 A | 7/1991 | Phillips | 52/743 |
| 5,248,122 A | 9/1993 | Graham | 264/35 X |
| 5,386,788 A | 2/1995 | Linker et al. | 109/58 |
| 5,435,255 A | 7/1995 | Elseser et al. | 109/56 |
| 5,487,251 A | 1/1996 | Tolliver et al. | 264/35 X |
| 6,195,946 B1 | 3/2001 | Lott et al. | 52/100 |
| 6,418,863 B1 * | 7/2002 | Marks | 109/84 |

OTHER PUBLICATIONS

First three pages of Applicant's specification of above–identified application, filed Aug. 16, 1999.

* cited by examiner

*Primary Examiner*—Suzanne Dino Barrett
(74) *Attorney, Agent, or Firm*—Hahn Loeser & Parks LLP; Laura G. Barrow

(57) ABSTRACT

Security vault panels and their method of manufacture are disclosed. Specifically, improved panels for manufacturing security vaults are disclosed, with each panel comprising (a) a rectangular metal mold having opposing metal end caps and opposing metal side rails and (b) a concrete slab disposed within the rectangular mold and permanently affixed thereto, the concrete slab having an exterior face and an interior face substantially uncovered by the mold. At least one of the metal side rails is configured to engage a complimentarily configured metal side rail of an adjacent panel. Three different configurations of metal side rails are disclosed for fabricating panels for subsequent installation as part of a wall, floor, or roof of the security vault.

3 Claims, 18 Drawing Sheets

MODULAR SECURITY VAULT PANELS

This is a continuation application of Ser. No. 09/375,035, filed Aug. 16, 1999, and issuing Jul. 16, 2002 as U.S. Pat. No. 6,418,863, and which is further incorporated herein by reference in its entirety.

I. BACKGROUND OF THE INVENTION

1. Field of the Invention

The present invention is directed to modular security vaults for use by various institutions, especially banks and jewelers, for storing money, valuables, and other items that are at high risk for theft. Specifically, the present invention is directed to the particular panels comprising the vaults and their method of manufacture.

2. Description of the Related Art

There are a number of different types modular security vaults, most of which are formed of concrete and/or metal such as steel. Modular vaults are made up of a series of standard and non-standard panels. When the panels are assembled and joined with a door, a secure vault system is formed. Because of the size and weight of many types of vaults, the individual panels that make up the vaults are generally manufactured off-site, and then shipped on-site for assembly. Since the panels can be quite heavy, due to the size and material composition of the panels, shipping costs can also be very expensive, making transport across country, for example, cost prohibitive in relation to the price of the vault itself.

A common method of fabricating a concrete modular panel for subsequent assembly into a security vault is by using a "fixed" mold or form which is preferably fitted with rebar mattes of structural steel. Typically, a conventional fixed mold has four sides and a bottom. A concrete chemical composition known in the art as a bond breaker is applied to the inner surface of the mold to prevent the concrete panel, upon curing, from adhering to the mold during removal therefrom. When the panel is removed from the mold, it is ready for installation. The mold may then be reused for the fabrication of subsequent concrete panels. An advantage of this method is that the vault manufacturer can create an inventory of panels having standard widths for subsequent assembly. Also, since there is no steel used on the outside of the panel, material costs are significantly less. Shipping costs are also decreased by the elimination of the steel from the panel, thus making the panel lighter. However, one major disadvantage of this method is that the ability to design custom vaults is somewhat limited due to the cost of manufacturing these molds, since building, repairing, and replacing such molds is quite expensive. Also, as the molds gradually wear, the quality of the finished panels is diminished.

Another method of constructing concrete-based modular vault panels is by what is known as the "pan-style" method, as illustrated in FIGS. 1A–1F. Here, 18-GA. galvanized sheet metal (1) is sheared and formed into a three-sided "pan." FIG. 1A is a flow chart illustrating a series of exemplary bends made on a flat piece of 18-GA steel to fabricate the pan. As shown in FIGS. 1B–1C, the pan is then end-capped on both sides with a sheet of 11 GA steel (3) to create a five-sided mold for a vault panel, the top side of which is left open for purposes of pouring the concrete therein. The mold is then fitted with reinforced steel, preferably a steel rebar matte (3). In this method, the entire mold will ultimately become part of the finished panel (P) (FIG. 1F). Thus, the number of molds constructed per the pan-style method is the same as the number of finished panels needed to assemble the security vaults. Once the molds are constructed, they are laid out in sequence on a concrete pouring deck per the engineering blueprints. The sides and end caps forming the individual molds are then tack welded together so that the seams remain tight, thereby ensuring a quality fit. The seams are further covered with an adhesive cloth to keep them clean. Concrete is then poured into the assembled molds and left to cure. Upon curing, the vault panels are removed for subsequent installation.

An advantage of the pan-style method of vault panel construction is that the manufacturer has complete flexibility in the design of custom vaults, since the "mold" portion of the panel is created per plan specifications prior to the concrete pour. Since the mold becomes part of the finished panel, there are no expensive molds to build or repair. Also, adjacent panels may be welded together via the metal mold component of the panel. The seams remain tight, thereby eliminating gaps, and the overall quality of the assembled vault is improved as opposed to the conventional fixed mold method discussed above. A major disadvantage of the pan method, however, is that the costs of material and labor are much higher than for the fixed mold method due to the incorporation of the sheet metal. And unlike for the fixed mold method, an inventory of pan-style molds cannot be maintained.

II. BRIEF DESCRIPTION OF THE FIGURES

Figure 4A:
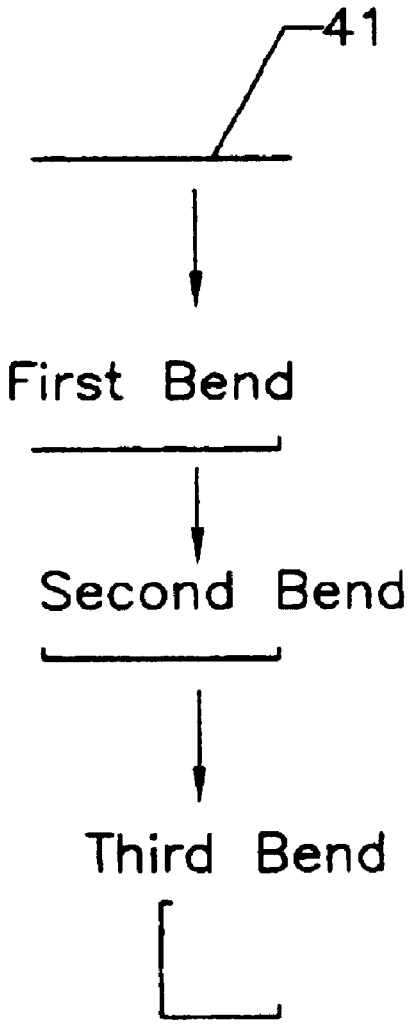

FIG. 4A flow chart illustrating the fabrication of a third metal side rail component style of the present invention (i.e. "butt" rail design).

Figure 4B:
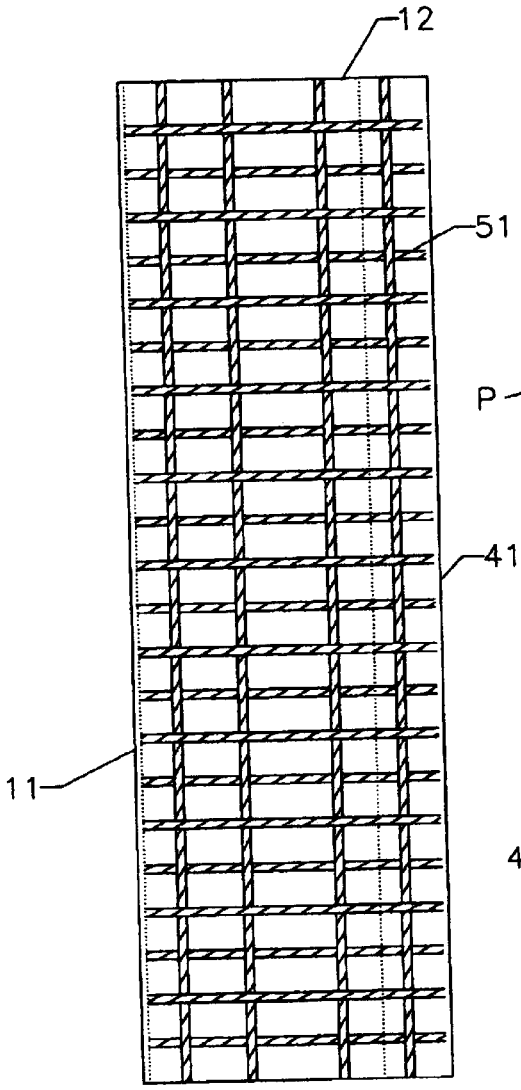

FIG. 4B is a plan view of the assembled mold, including rebar matte, employing a standard rail component and a butt rail component.

Figure 4C:
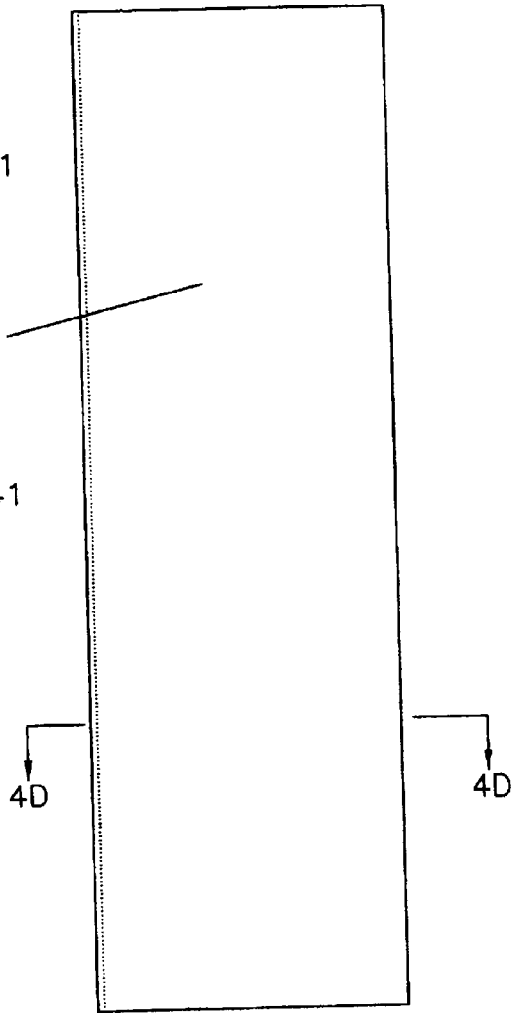

FIG. 4C is a plan view of the fabricated concrete/metal panel assembled per the present invention using the mold illustrated in FIG. 4B.

Figure 4D:
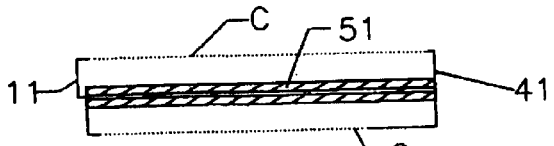

FIG. 4D is a cross-section view of the panel shown in FIG. 4C taken along lines 4D—4D.

Figure 5A:
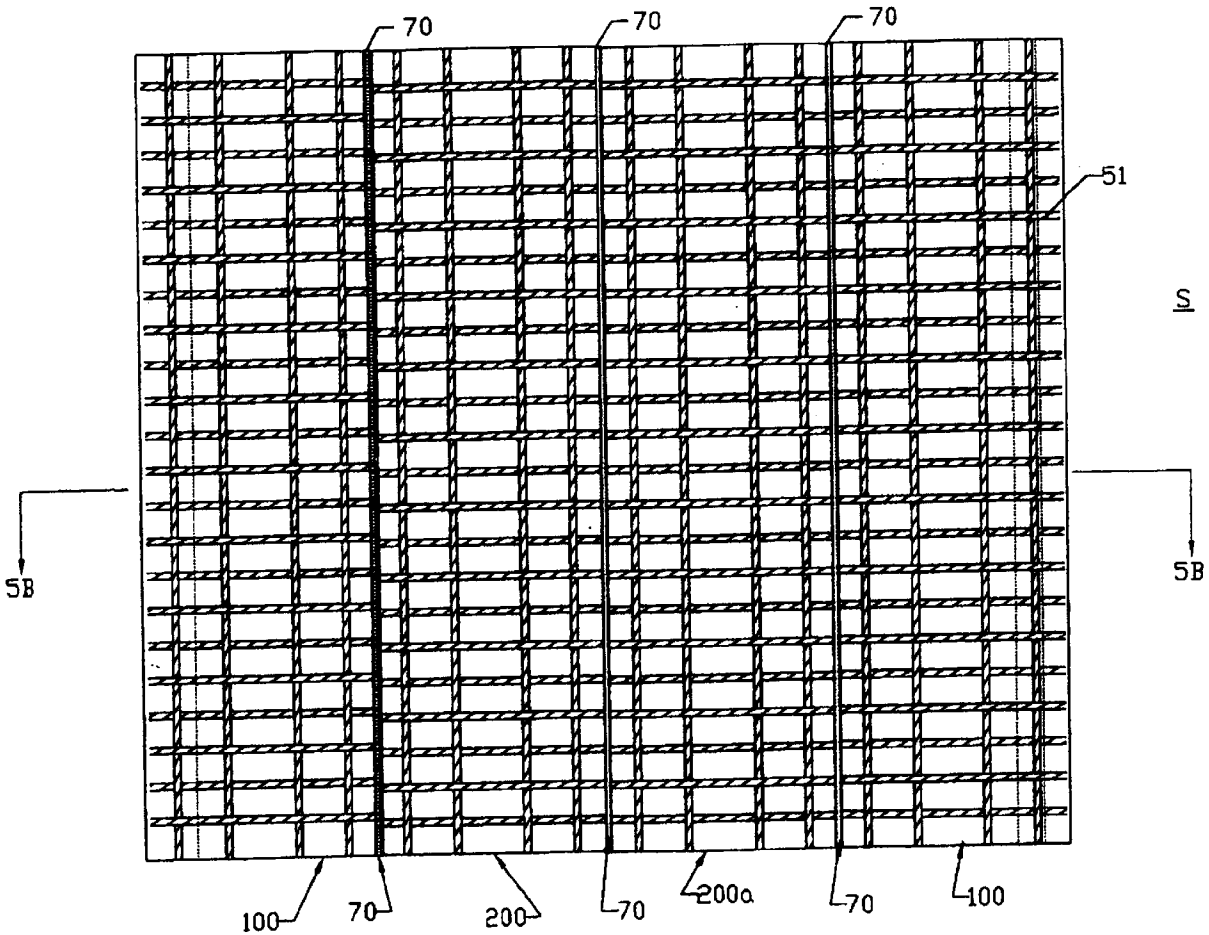
Figure 6:
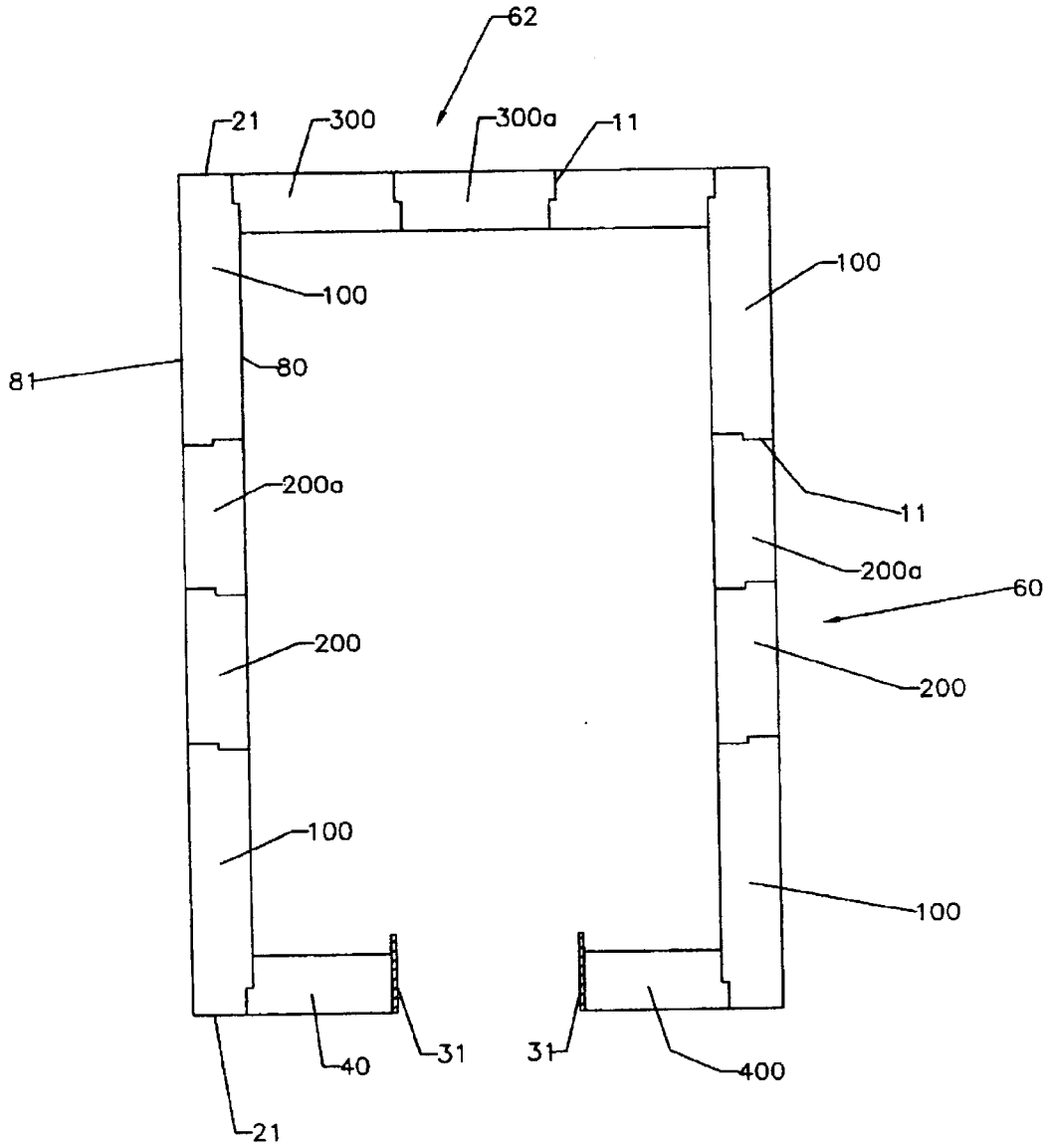

FIG. 5A is a plan view of a series of assembled molds, welded together, for fabricating panels for subsequent assembly of a side wall of an exemplary vault illustrated in FIG. 6.

Figure 5B:
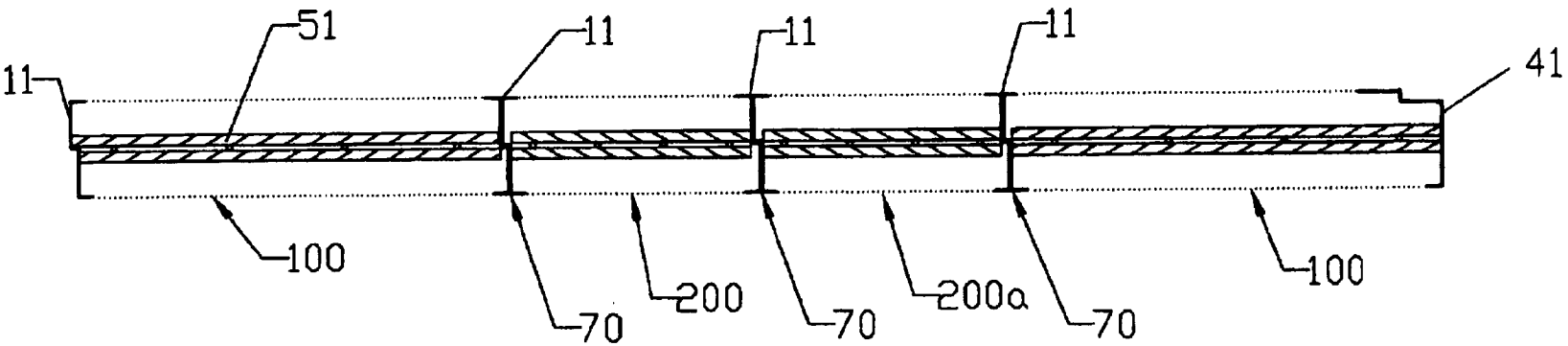

FIG. 5B is a cross-section of the assembled molds taken along lines 5B—5B in FIG. 5A.

Figure 9:
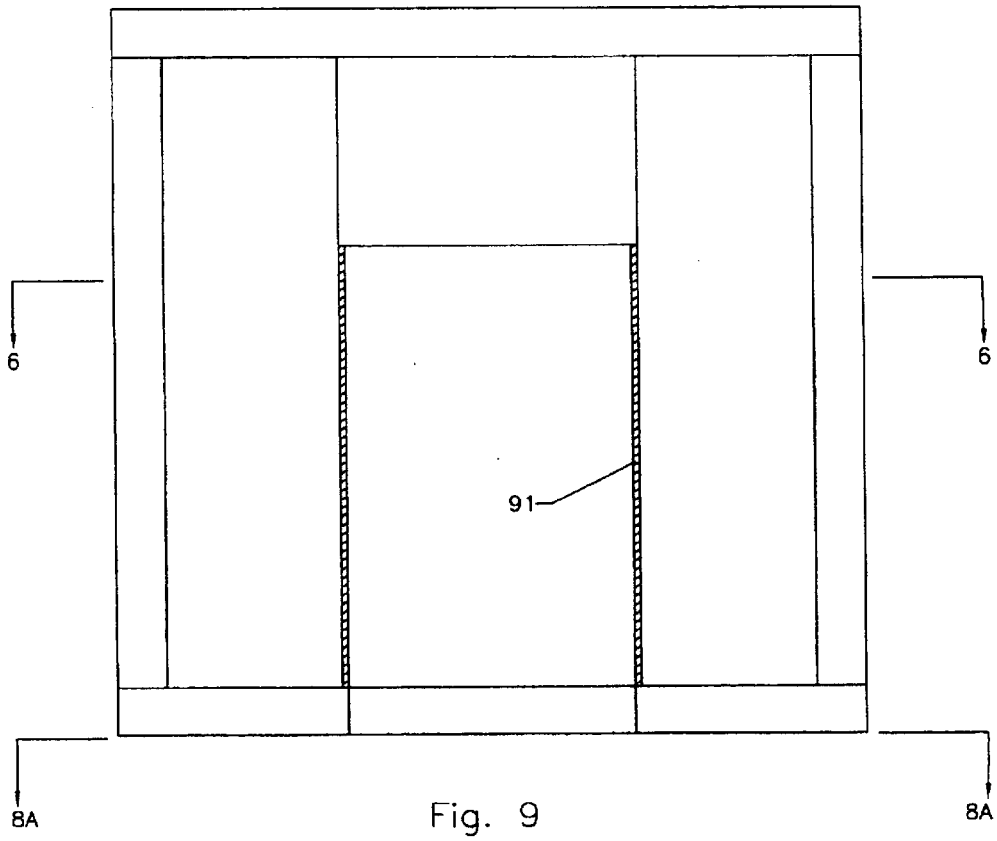

FIG. 6 is a mid-section view of the vault shown in FIG. 9 taken along lines 6—6 in FIG. 9.

Figure 7B:
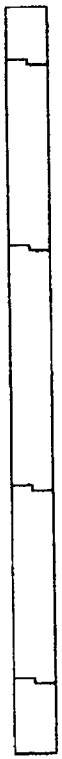
Figure 7A:
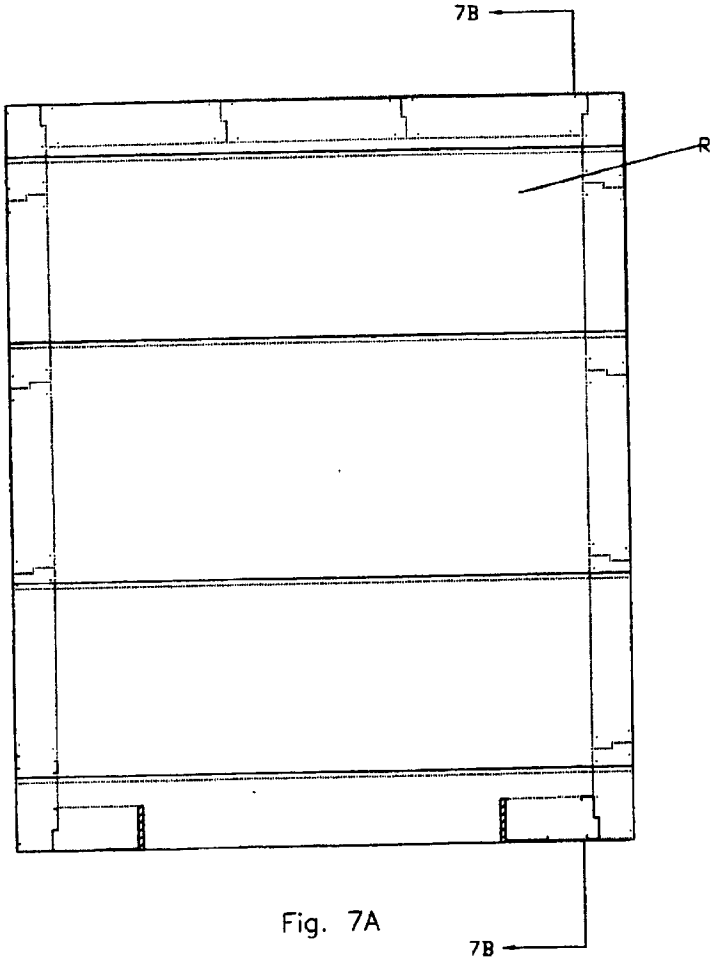

FIG. 7A is a plan view of the vault shown in FIG. 9 illustrating the roof.

FIG. 7B is an end view taken along lines 7B—7B in FIG. 7A.

Figure 8A:
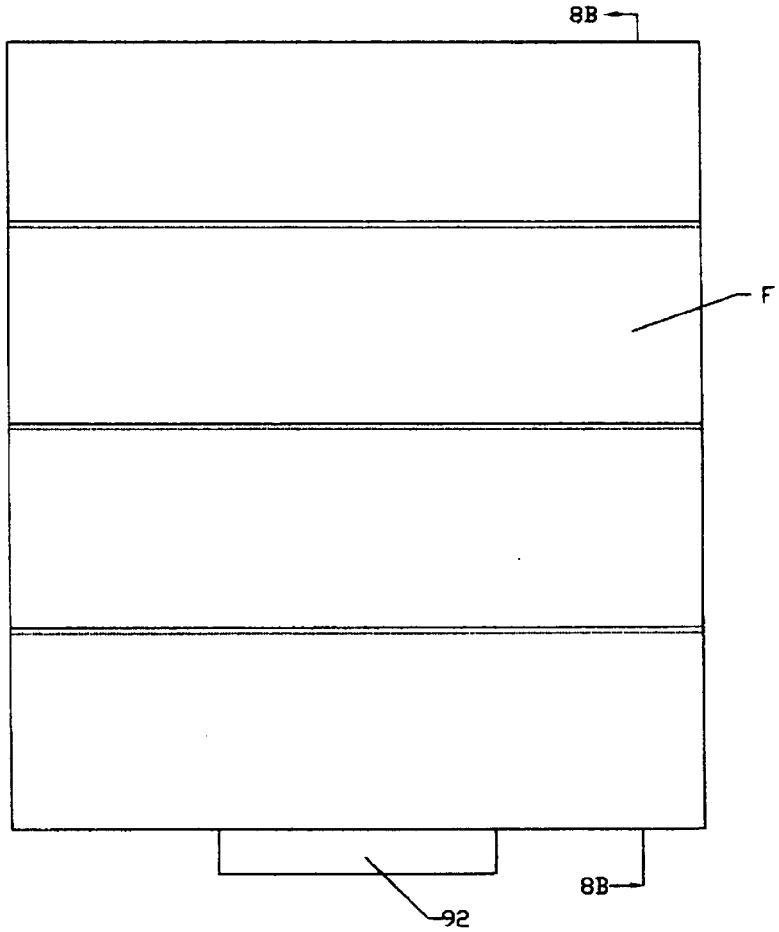

FIG. 8A is a plan view of the vault taken along lines 8A—8A in FIG. 9 illustrating the vault floor.

Figure 8B:
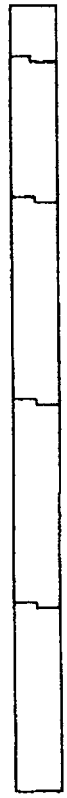

FIG. 8B end view taken along lines 8B—8B in FIG. 8A.

FIG. 9 is a front view of a vault assembled using the panels of the present invention.

Figure 10:
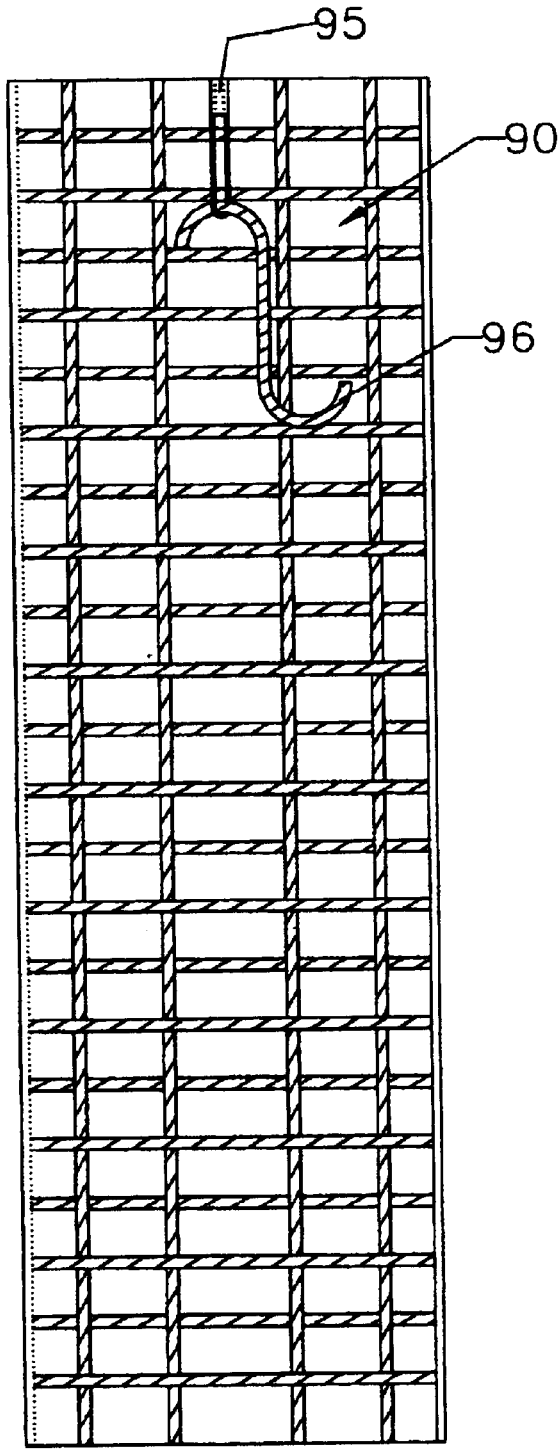

FIG. 10 is a plan view of the inventive panel with a lifting bolt attached thereto for picking up the panel during assembly of the security vault.

III. SUMMARY OF THE INVENTION

The present invention is directed to an improved modular vault system that has the advantages of both prior art panels and methods of manufacturing without their respective disadvantages, thereby improving the quality of the finished panels at a reduced cost to the manufacturer and ultimate purchaser. Specifically, the vault comprises a plurality of panels which have been manufactured prior to assembly into the vault, wherein one or more of the panels is suitable for forming the walls, roof, and floor of the finished vault. In certain embodiments, each panel comprises a rectangular outer mold comprising a pair of metal side rails and a pair of opposing metal end caps, with one of the opposing metal end caps forming a top end and the other end cap forming the bottom end of the mold. The metal end caps are permanently secured to the opposing metal side rails. Each panel also includes a concrete slab disposed within the mold and to which the slab is permanently affixed. The concrete slab has an exterior face and an interior face substantially uncovered by the mold.

The metal side rails are configured via a series of bends to engage a complementarily configured metal side rail of an adjacent panel for engagement therewith. Preferably, at least one of the metal side rails contains a recessed portion configured to receive a complementary projected portion of a metal side rail of an adjacent panel. The particular configuration of the metal side rail will depend upon the desired location of the panel within the assembled vault.

The present invention is also directed to a method of constructing the individual panels for subsequent assembly into a security vault. In certain embodiments, a four-sided mold is assembled by welding together a pair of opposing metal end caps to a pair of opposing metal rails to form a rectangular mold. The rails, as discussed above, are preferably configured to engage a complementarily configured metal rail of an adjacent panel constructed per the inventive method. After the assembled mold is positioned on a substantially flat application surface, concrete is poured into the four-sided mold directly onto the application surface to form a concrete slab disposed therein upon curing. Upon curing, the inner concrete slab and the outer rectangular mold are permanently affixed to the outer perimeter of the concrete slab, leaving the exterior and interior faces of the slab substantially uncovered by the mold to create a finished panel. After a sufficient curing time, the panel is removed from the application surface for subsequent assembly with complementary panels to form a security vault.

Preferably, the inventive method comprises constructing a series of molds corresponding to all of the panels required for a particular vault, similar to the pan-style method described above. A wall portion of the vault, for example, may be created by laying out the required number of molds, in sequence, onto the application surface. The number of molds corresponds to the number of panels comprising that particular wall portion. The molds are tack welded together to provide a tight seam prior to the concrete pour. This procedure of securing the molds prior to pouring the concrete also helps ensure a true alignment of the panels for the particular section of the vault to be assembled on sight. Upon curing, the tack welds are broken, and the individual finished panels are removed for subsequent shipment to the vault installation/assembly sight. This same procedure is performed for constructing the floor and roof of the vault.

The present invention is also directed to a kit for manufacturing concrete panels for subsequent assembly into a security vault. Specifically, the kit comprises at least two metal side rails and two metal end caps for assembly into a four-sided, rectangular mold. The mold, as discussed above, is designed for permanent affixation to an inner concrete slab upon curing of a concrete mixture previously poured into the mold. The metal side rails of the mold are further configured for engagement with complementarily configured metal side rails of adjacent panels The present invention has the advantages of the pan-style method discussed above in that the metal component of the panel provides improved strength to the panels. Like the pan-style method, there is great flexibility in custom designing panels; however, the costs of fabrication are significantly decreased by the elimination of the large steel bottom section of the pan-style mold. In fact, the inventive method utilizes at least three different configurations of rail components for assembly into end caps and side rails which will make up any panel design. Thus, an inventory can be readily maintained with minimum storage requirements. The individual side rail/end cap components that make up the "mold" can be shipped separately for on-site assembly, thereby drastically decreasing shipping costs that have otherwise made long distance shipping cost-prohibitive.

IV. DETAILED DESCRIPTION OF THE PREFERRED EMBODIMENT

Referring now to the figures, specifically FIGS. 2A–2G, the preferred embodiment of the present invention comprises, in part, the employment of a four-sided mold having two metal side rails (11) and two opposing metal end caps (12). In particular, the metal side rails selected for manufacturing a particular panel will depend upon the location of the panel in the assembled vault (i.e. a corner panel, a side panel, roof panel, floor panel, or straight wall panel). Also, the panels may comprise any combination of side rails and complementary end caps depending upon the vault design specifications, as discussed further below (e.g. two standard rails; one standard rail/one corner rail; one standard rail/one butt rail; etc.).

In the preferred embodiment, the metal side rails may be one of three different configurations, and for ease of explanation, will be referred herein as the "standard" rail style (FIGS. 2A–2G), the "corner" rail style (FIGS. 3A–3D), and the "butt" rail style (FIGS. 4A–4D). The "butt" rail style is designed primarily for the floor, roof, and door panels. It will be appreciated by those of ordinary skill in the art, however, that different configurations of metal side rails may be employed to construct the panels, depending upon the desired design of the vault. The standard side rails (11) and corner side rails (21) each comprise a recessed portion (110, 210) and a projected portion (111, 211), wherein the recessed portion of one metal rail is configured for receiving a complementarily configured projected portion of a metal side rail of an adjacent panel for tight-fitting engagement therewith. This type of interlocking junction formed between adjacent panels, which results in off-setting, non-continuous joints between panels, is a well-established practice in the art and confers greater resistance against burglar invasion through these joints.

A distinct advantage of the present invention is that each individual panel may be constructed utilizing a rectangular mold that ultimately becomes an integral, four-sided metal enclosure about the perimeter of the finished panel (unlike the fixed mold method), as opposed to a bulkier five-sided mold, as described for the pan-style method above.

Figure 1A:
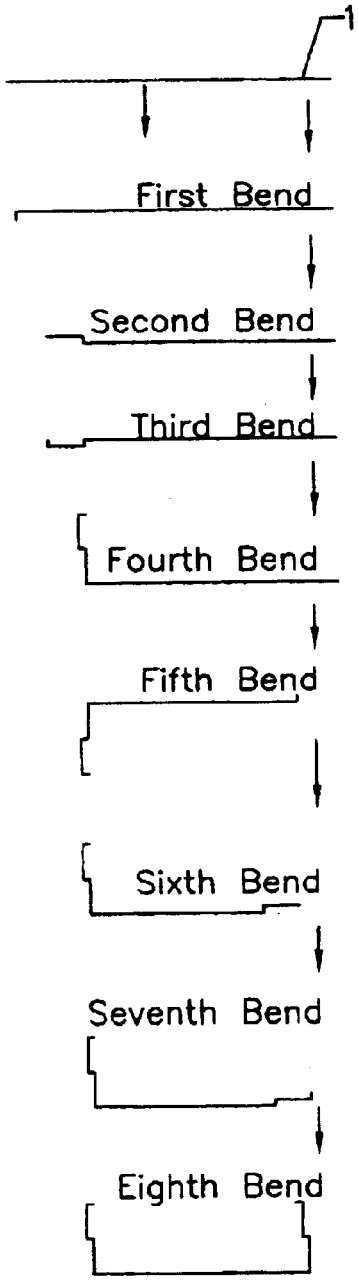
Prior Art Fig. 1A
FIG. 1A is a flow chart illustrating the fabrication of the prior art pan-style mold used for manufacturing vault panels.
Figure 1B:
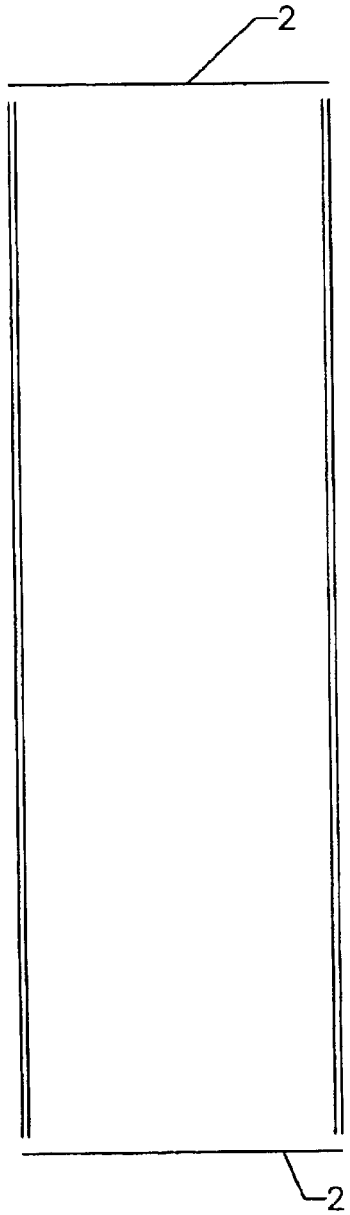
Prior Art FIG. 1B
FIGS. 1B–1E illustrate the steps in fabricating the prior art pan-style panel of FIG. 1F.
Figure 1C:
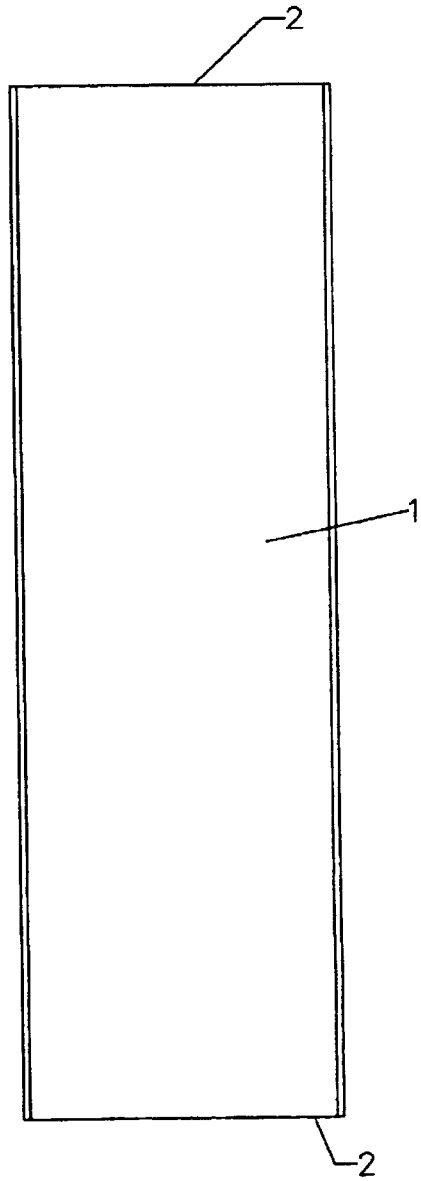
Prior Art FIG. 1C
Figure 1D:
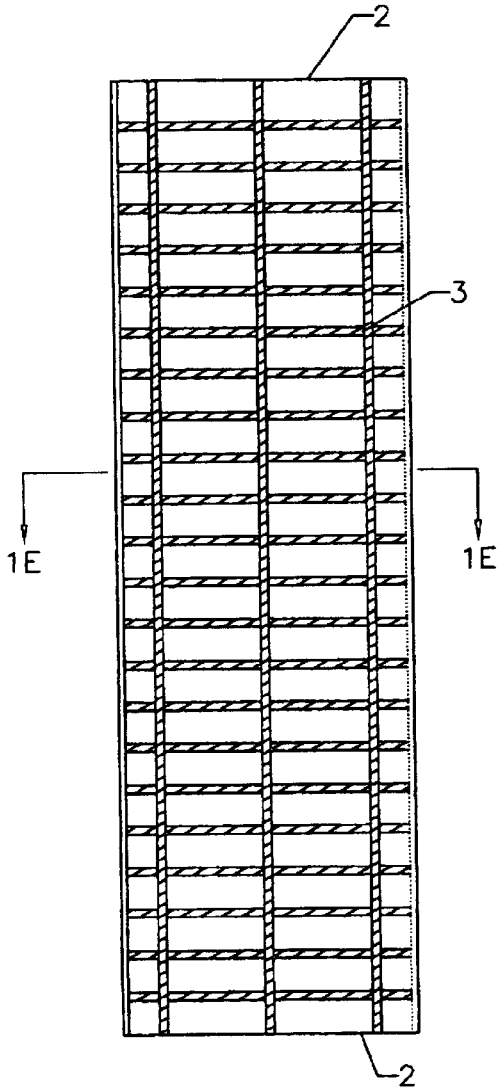
Prior Art FIG. 1D
Figure 1F:
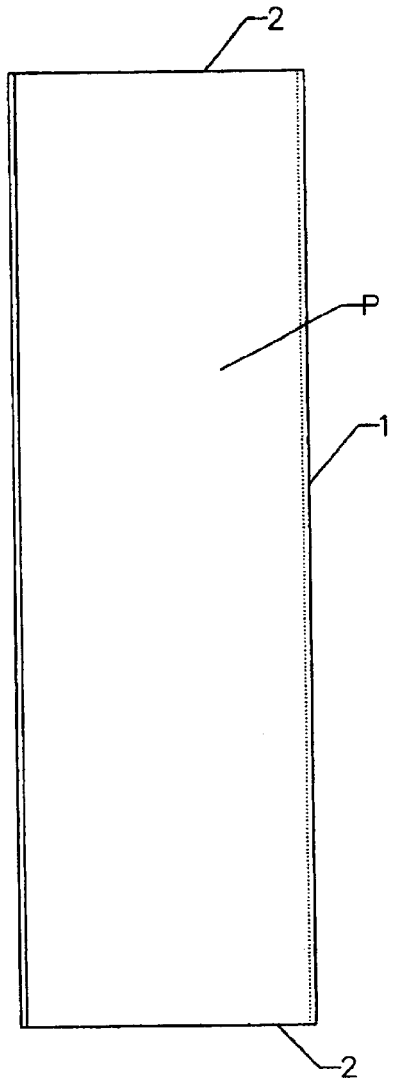
Prior Art FIG. 1F
FIG. 1F is a plan view of the fabricated panel assembled per the prior art pan-style mold method illustrated in FIGS. 1B–1E.
Figure 1E:
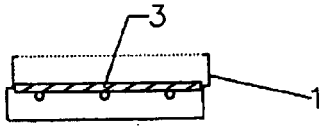
Prior Art FIG. 1E
Figure 2A:
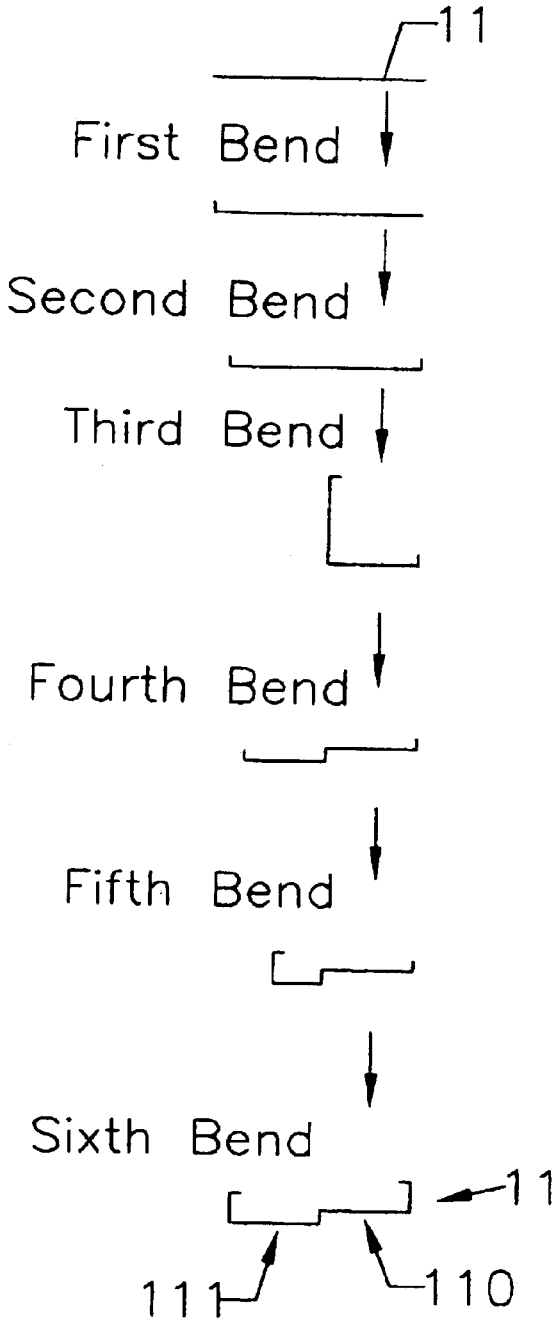
FIG. 2A is a flow chart illustrating the fabrication of one metal side rail component style of the present invention (i.e. "standard" rail design).
Figure 3A:
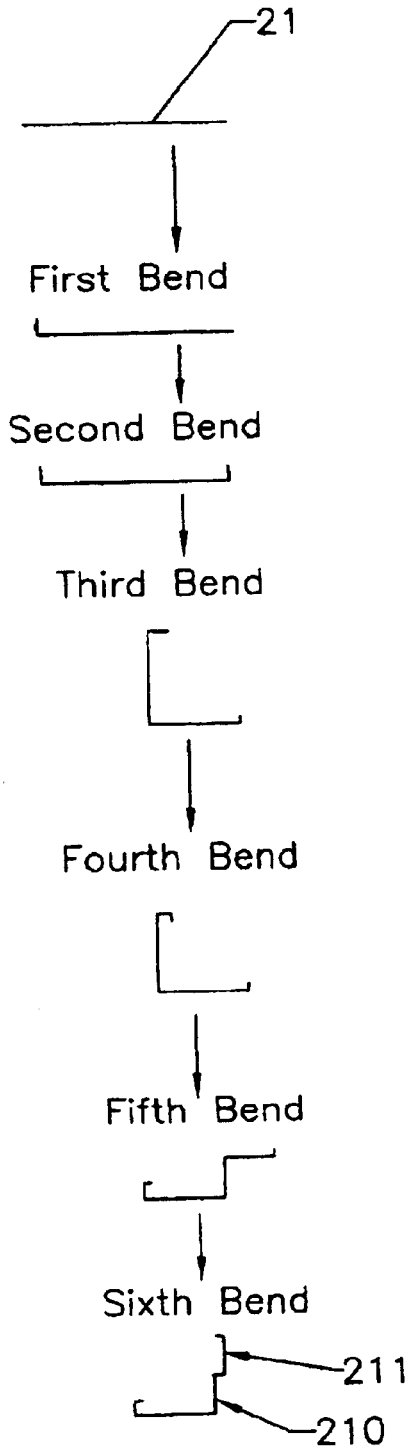
FIG. 3A is a flow chart illustrating the fabrication of a second metal side rail component style of the present invention (i.e. "corner" rail design).
Figure 3B:
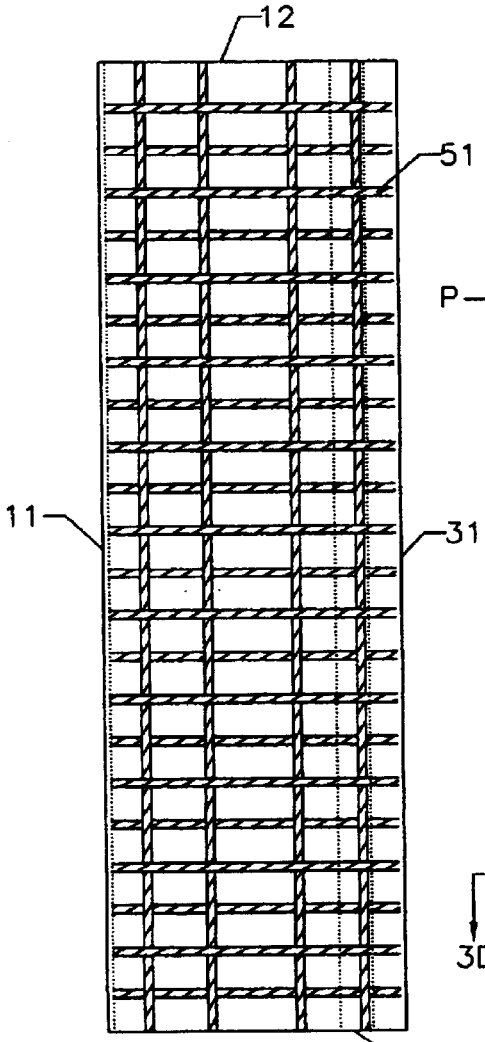
FIG. 3B is a plan view of the assembled mold, including rebar matte, employing a standard rail component and a corner rail component.
Figure 3C:
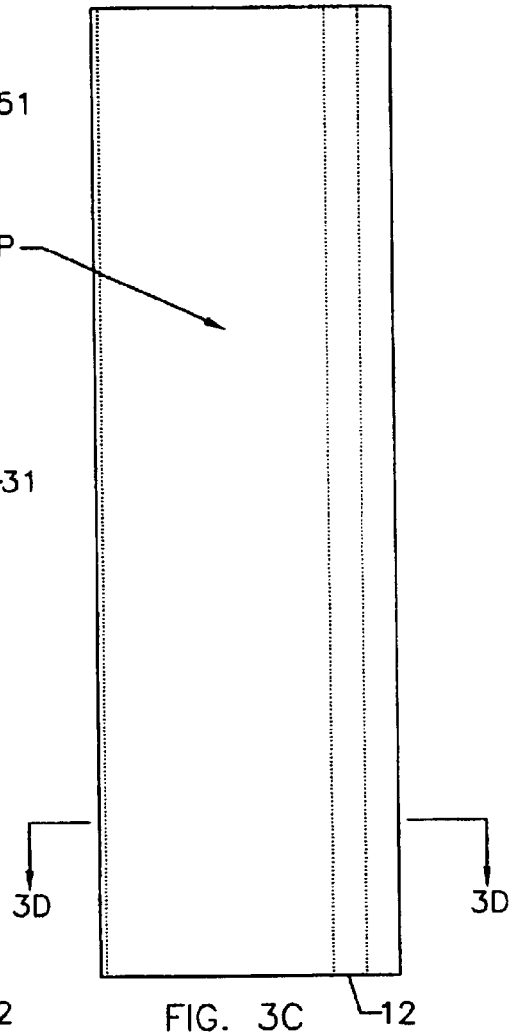
FIG. 3C is a plan view of the fabricated concrete/metal panel assembled per the present invention using the mold illustrated in FIG. 3B.
Figure 3D:
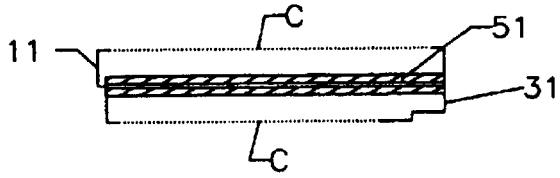
FIG. 3D is a cross-section view of the panel shown in FIG. 3C taken along lines 3D—3D.

FIG. 2A is a flow chart illustrating a series of bends that may be made to form the recessed (110) and projected (111) portions of a standard side rail (11). FIGS. 3A and 4A show similar flow charts for the fabrication of the inventive corner rails (21) and butt rails (31), respectively. The skilled artisan, however, will appreciate that these flow charts illustrate only one exemplary sequence of rail bending, and that the final configuration of the rails may be achieved by different bending sequences.

Figure 2B:
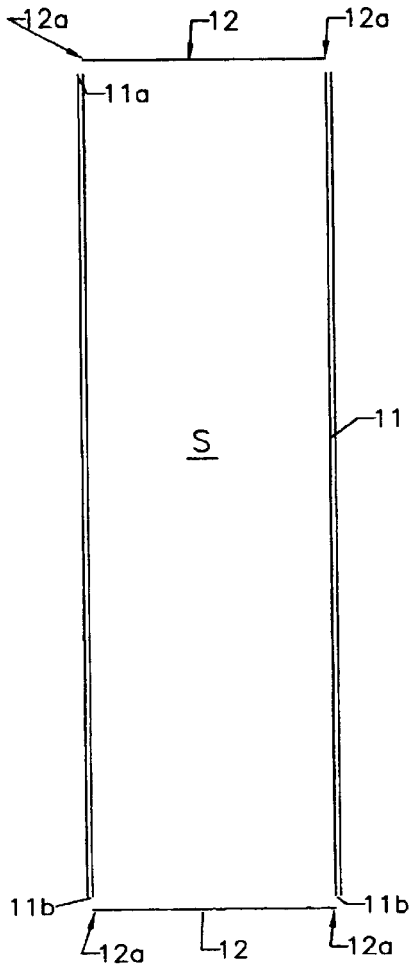
FIG. 2B is an exploded view of the mold formed of two end caps and two "standard" style side rails of the present invention.
Figure 2C:
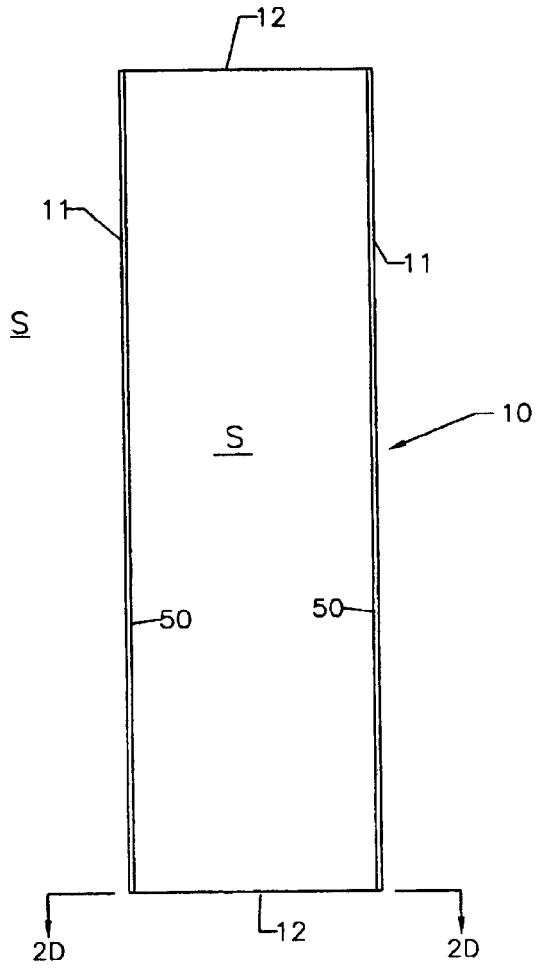
FIG. 2C is a plan view of the assembled mold of FIG. 2B prior to the insertion of the rebar matte.
Figure 2D:
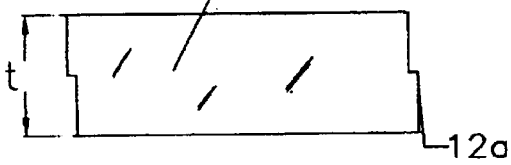
FIG. 2D is a front end view of the mold shown in FIG. 2C taken along lines 2D—2D.
Figure 2E:
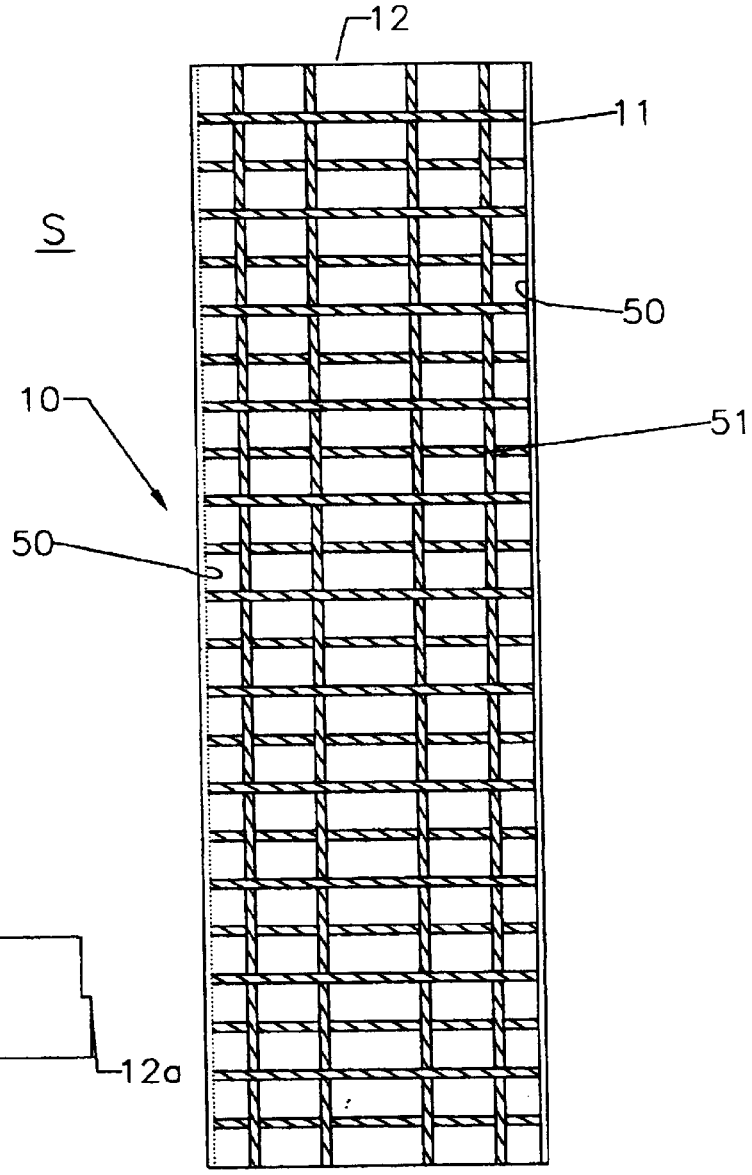
FIG. 2E is a plan view of the assembled mold of FIG. 2C including the rebar matte.
Figure 2F:
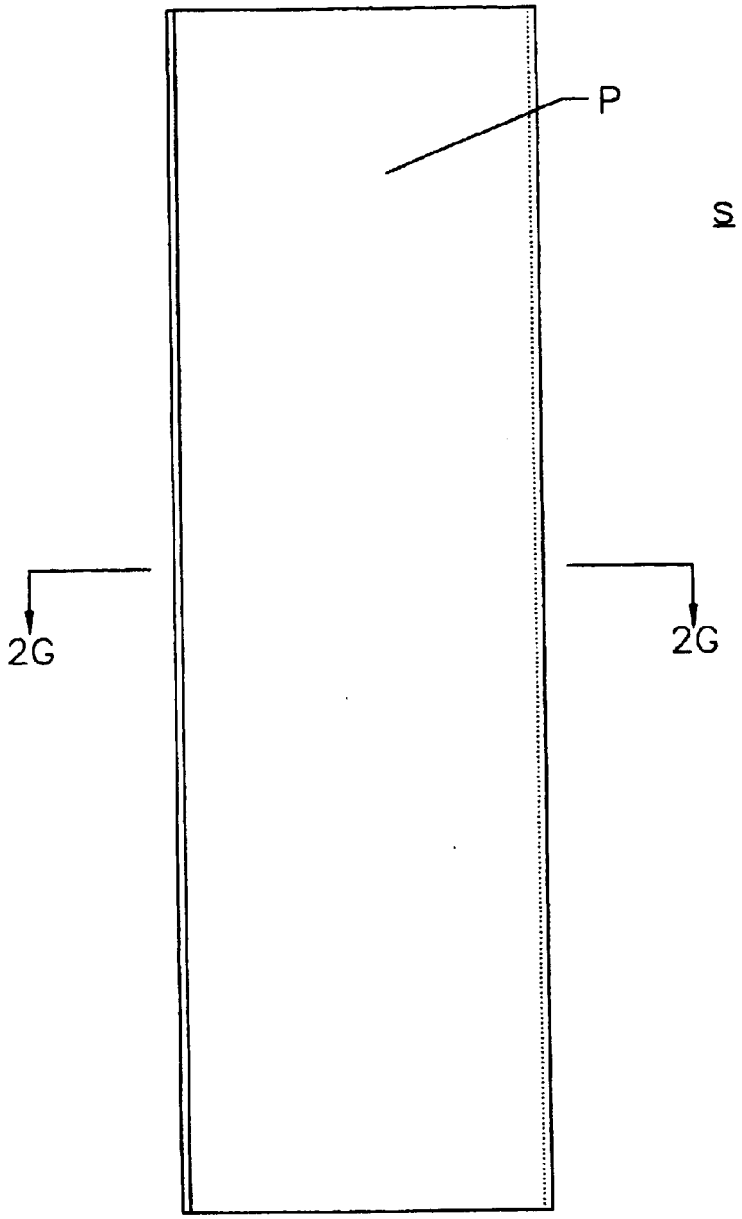
FIG. 2F is a plan view of the fabricated concrete/metal panel assembled per the present invention using the mold illustrated in FIG. 2E.
Figure 2G:
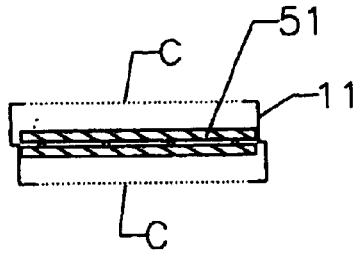
FIG. 2G is a cross-section view of the panel shown in FIG. 2F taken along lines 2G—2G.

FIGS. 2B–2G illustrate the inventive method of assembling the side rails (11) and end caps (12) of the standard rail style. The standard side rails will be referenced generally herein as (11), to be distinguished from the corner style (21) and butt style (31). Once a pair of standard side rails (11) are constructed to the desired shape, as shown for example in FIG. 2A, they are welded to opposing end caps (12), as shown in FIGS. 2B–2C. The end cap (12) is configured such that its side edges (12*a*) complement the shape of the top and bottom edges (11*a*, 11*b*) of the side rail (11), as shown in FIGS. 2B–2D, for example, so that a tight seam can be achieved therebetween upon welding. Preferably, the metal employed for the rails is 18 GA. galvanized steel, while the preferred metal for the end caps is a 11 GA. galvanized steel. FIGS. 2C–2D illustrate the assembled 4-sided mold (10). Next, reinforced steel is welded to the inner surfaces (50) of the mold, most preferably a ⅝ inch grade 60 rebar matte (51), as shown in FIGS. 2E–2G. While FIGS. 2A–2G illustrate the construction of a panel having two standard rail (11) components (11); as mentioned previously, the panel may also incorporate a standard rail in combination with either a corner rail (21) (see FIGS. 3C and 3E) or a butt style rail (41) (see FIGS. 4C and 4E). Other combinations of rail components are also contemplated, depending upon the design specifications of the vault itself.

The mold (10) is then placed onto a substantially flat application surface (generally indicated at "S"), such as a concrete floor or platform, that has been previously treated with a chemical concrete form release agent (i.e. a "bond breaker"). The bond breaker (not shown) will prevent adherence of the concrete portion of the panel to the application surface upon subsequent pouring and curing. While any suitable bond breaker typically used in the art for this function can be employed, exemplary bond breakers include, but are not limited to, CLEAN STRIP C&M, a petroleum-based bond breaker distributed by Dayton Superior Corporation (Oregon, Ill.), and BURKE CLEAN LIFT 90, also a petroleum based bond breaker manufactured by Burke (Long Beach, Calif.). It should be noted that alternatively, the four-sided mold made be placed onto the application surface just prior to application of the selected bond breaker.

Like the pan-style method discussed above, a number of four-sided molds (10) are placed side-by-side in sequence to correspond to the arrangement of the panels in the assembled vault. For example, a series of molds corresponding to a side wall (60), such as that shown in FIG. 6, for example, will be arranged on the concrete application surface (S), as shown, for example, in FIGS. 5A–5B. The roof (R), floor (F), rear wall (62), and opposite side wall (61) are similarly manufactured. Prior to pouring the concrete into the mold(s), the side rails of adjacent molds are tack welded together to ensure a tight fit at seam (70) (FIG. 5A). A sufficient amount of high strength concrete is then poured into the mold to completely cover the rebar matte (50) and mold, preferably up to the outer edge of the rail, as best shown in dotted lines in FIGS. 2G, 3D, 4D, and 5B, for example (the dotted lines shown in the cut-away sections represent concrete surfaces (C) or the prospective concrete surface prior to the concrete pour (e.g. FIG. 5B), while the bold lines represent metal surfaces of the side rails (11, 21, 31) and end caps (12)). Any high strength concrete mixture typically used in the construction of security vaults that meets known, industry standards may be employed. Typical concrete curing times range from about three days prior to moving the panels to about 30 days for a complete cure, depending upon the size of the panel, the temperature, and humidity. Upon curing (i.e. about three days), the tack welds are broken and the individual finished panels are separated from one another for subsequent shipment to the vault installation/assembly site. Each finished panel comprises the mold permanently affixed to the concrete slab disposed therein, with the concrete slab portion of the panel having an exterior face (81) and interior face (80) substantially uncovered by the mold (see FIG. 6, for example). In order to lift the individual panels for assembly into a security vault, each panel preferably includes a lifting assembly (90) comprising a bolt (95) secured to the rebar matte (50) on one end and centered near the top end of the mold, as shown in FIG. 10. The other end of the bolt (95) is secured to an S-shaped rebar wire (96). The other end of the wire (96) is secured to the rebar matte (50) and embedded in concrete upon pouring/curing. Preferably, the lifting assembly (90) is structured to allow the panels to spin freely prior to installation.

It will be appreciated by those of ordinary skill in the art that the lengths and widths of the rails and end caps as well as the widths of each panel will vary depending upon the design of the particular security vault. A conventional wall thickness (t) for Class 1 security vaults is about 5.0–6.5 inches (see FIG. 2D, for example). Preferred spacing between the bars in the rebar matte, for example, range from 4 to 5½ inches. Typical lengths (L) for each panel range from 96 inches to about 160 inches. A preferred width (W) is about 36 inches. Moreover, the number and arrangement of panels will depend upon the desired size and shape of the vault. FIG. 6 is an exemplary mid-section view (taken along lines 6—6 of FIG. 9) illustrating the assembly of different panels constructed via the inventive method. In this example, the vault (V) comprises four panels (100) having a corner rail (21) and standard rails (11). The two side walls (60) of the vault each have two panels (200, 200*a*) incorporating standard rails (11) in addition to the two corner panels (100). The vault has a rear wall (61) formed of three panels (300, 300*a*) that also employ standard rails (11), and two front panels (400) which include standard rails (11) and butt rails (31) for adjoining doors (not shown). Tee panels (200*a*, 300*a*) are positioned on the side walls (60) and rear wall (61), as shown in FIG. 6. The tee panels are used to connect two corner panels (300) or a corner panel (100) and a side panel (200). FIG. 7A is a top plan view showing the roof (R) of the vault (V) (the underlying rear, front, and side walls are shown in phantom lines). FIG. 7B is a section view of the roof (R) only that illustrates how the panels interconnect. FIG. 8A is a plan view of the floor (F) section only, including the door sill (92), with FIG. 8B also showing how the separate panels making up the floor (F) interconnect. Finally, FIG. 9 is a front view of the assembled security vault (V) showing the position of the steel door frame (91).

In assembling the security vault, the individual panels are first numbered in the recommended order of installation per the design specifications of the vault. The floor upon which the vault is to be assembled should be marked to correspond with the number of panels required for the floor section of the vault. The panels are then aligned on the floor. After three or four floor panels are in place, they should be cross taped to ensure that the panels are staying square during assembly. If the panels exceed the design dimension by ¼ inch or more, a gap should be created between the adjacent panels to square the floor.

In assembling the back wall panels, the corner panels are first installed. The corner panels should be plumb before installing any other panels. As the back wall panels are set in place, the cumulative length (L) of the wall should be checked after three or four panels are installed. If the cumulative length is within the design dimension, three or more back wall panels may be installed next to the previous back wall panels. If the cumulative length does not equal the design dimension, a gap should be placed between the adjacent panels to square the wall. The remaining back wall panels should be installed, with the length checked after every third or fourth panel and after placing the final panel. As the back wall panels are installed, they should be tack welded to adjacent panels at the top, middle, and bottom of the panel(s) to hold the panels in place.

If the ceiling panels are to be aligned parallel to the vault door-opening, they should be installed in conjunction with the side wall panels and in the following order: (1) first left side wall panel; (2) first right side wall panel; (3) first ceiling panel. Subsequent panels are installed in the same order (i.e. left side wall panel, right side wall panel, then ceiling panel). If the ceiling panels are to be aligned perpendicular to the vault door opening, the side wall panels should be installed prior to installation of the ceiling. Installation of the panels should continue from the back towards the front of the vault, checking the cumulative length of each vault panel after placing every third or fourth adjacent panel, as described above for the back wall panels. If the cumulative length does not equal the design dimensions, a gap should be placed between the panels and the next panel, as discussed above. All interior and exposed exterior seams should be welded with one-inch welds, spaced every 8 inches on center. All exposed exterior seams as well as any interior seams with excessive gaps should be caulked.

The present invention provides an economical solution to the cost of transporting and manufacturing modular panels for on-site vault assembly that has all of the advantages of the pan-style method without the disadvantages inherent in incorporating a five-sided enclosure per the pan-style method. The inventive method allows the manufacturer to maintain an inventory of standard rails which can also be easily shipped away for on-site installation and for less expense due to less metal being employed. The integrity of the assembled vault constructed per the inventive method is as good as vaults having panels constructed per the "pan-style" method.

The foregoing disclosure and description of the invention are illustrative and explanatory thereof, and various changes in the size, shape, and materials, as well as in the details of the illustrated construction may be made without departing from the spirit of the invention, and therefore fall within the scope of the appended claims even though such variations were not specifically discussed above.

I claim:

1. A security vault comprising a plurality of panels suitable for forming the walls, roof, and floor of said vault, wherein at least one of said plurality of panels further includes:

(a) a rectangular outer mold comprising a pair of opposing metal side rails and a pair of opposing metal end caps, wherein one of said opposing metal end caps forms a top end and another of said end caps forms a bottom end of said panel, each of said metal end caps being permanently secured to said opposing metal side rails, and wherein at least one of said pair of metal side rails comprises a recessed portion and a projected portion integral with, and adjacent to, said recessed portion, said recessed and projected portions of said side rail extending entirely from said top end to said bottom end of said mold, and wherein said recessed portion is configured to receive a complementarily configured projected portion of a metal side rail of an adjacent panel, said projected portion of said adjacent metal side rail extending entirely from said top end to said bottom end of said mold; and (b) a concrete slab disposed within said rectangular mold and permanently affixed thereto, said concrete slab having an exterior face and an interior face substantially uncovered by said four-sided mold.

2. The security vault of claim 1, wherein each of said panels includes reinforced steel disposed within said concrete slab and fixedly secured to an inner surface of said mold.

3. The security vault of claim 1, wherein said metal end caps and metal side rails are formed of steel.

* * * * *